US005771973A

United States Patent [19]

Jensen et al.

[11] Patent Number: 5,771,973

[45] Date of Patent: Jun. 30, 1998

[54] SINGLE WELL VAPOR EXTRACTION PROCESS

[75] Inventors: Earl M. Jensen; Kurt D. Uhrich; David J. Hassan, all of Calgary, Canada

[73] Assignee: Amoco Corporation, Chicago, Ill.

[21] Appl. No.: 686,577

[22] Filed: Jul. 26, 1996

[51] Int. Cl.[6] ..... E21B 36/00; E21B 43/24

[52] U.S. Cl. ..... 166/303; 166/50; 166/306

[58] Field of Search ..... 166/50, 267, 272.2, 166/272.3, 272.4, 272.7, 303, 305.1, 306

[56] References Cited

U.S. PATENT DOCUMENTS

| | | | |
|---|---|---|---|
| 3,960,213 | 6/1976 | Striegler | 166/50 X |
| 4,067,391 | 1/1978 | Dewell | 166/306 X |
| 4,116,275 | 9/1978 | Butler et al. | 166/50 X |
| 4,160,481 | 7/1979 | Turk et al. | 166/50 X |
| 5,127,457 | 7/1992 | Stewart et al. | 166/306 |
| 5,148,869 | 9/1992 | Sanchez | 166/303 |
| 5,273,111 | 12/1993 | Brannan et al. | 166/50 X |
| 5,289,881 | 3/1994 | Schuh | 166/303 |
| 5,411,094 | 5/1995 | Northrop | 166/50 X |
| 5,511,616 | 4/1996 | Bert | 166/306 X |

*Primary Examiner*—George A. Suchfield
*Attorney, Agent, or Firm*—James A. Gabala; Robert E. Sloat

[57] ABSTRACT

A method of producing hydrocarbons from a subterranean formation comprising the steps of: forming a well having a horizontal section located between the midpoint and the bottom of the formation and having a raised end; and continuously injecting a fluid through said raised end to induce hydrocarbons to flow towards the horizontal section in response to gravity drainage while continuously producing hydrocarbons through the horizontal section of the well-bore, so that the injection of fluids occurs simultaneously with the production of hydrocarbons.

48 Claims, 1 Drawing Sheet

SINGLE WELL VAPOR EXTRACTION PROCESS

TECHNICAL FIELD

This invention relates to the general subject of methods and devices for recovering hydrocarbons from subterranean formations, and, in particular, to processes and apparatus for recovering heavy oil by means of injecting fluids into the formation.

BACKGROUND OF THE INVENTION

It is well-known that liquid hydrocarbons, commonly known as crude oils, found in subterranean formations vary considerably as to viscosity and specific gravity. Crude oils with an API gravity of twenty-two degrees or less are generally considered to be heavy crude oils. As heavy crude oils are more difficult to treat, transport and refine than lighter crude oils, the market value of heavy crude oils has been historically lower than the value of lighter crude oils.

It is also known that the composition, thickness and condition of the subterranean formations in which crude oils are found vary a great deal. Hydrocarbon bearing formations can vary in physical composition from consolidated rock to unconsolidated sands, which may affect permeability and porosity. These formations may also vary in thickness from several hundred feet to less than six feet. Natural layering and mixing of a variety of natural impermeable materials within a subterranean formation can also occur. The presence of diagenetic clay, or impermeable partial barriers (such as mud or mud stone laminations), or calcite lenses within a subterranean formation may affect the ability of fluids to flow within the formation.

In subterranean formations of optimal characteristics and compositions, due to the higher viscosity of heavy crude oils, the application of conventional primary, secondary and tertiary production techniques and technologies may not enable economic recovery of heavy crude oils. Where heavy crude oil contained within a subterranean formation will initially flow at economic rates to and into the bore hole of a well under natural reservoir conditions, only a small fraction of the oil contained within the formation can be produced by conventional means. Achieving rates and volumes of recovery from a subterranean formation containing heavy crude oil, comparable to a similar formation containing lighter crude oil, can in general, only be accomplished at a higher production cost.

In order to improve the economics of producing heavy crude oils, it has been well understood that the introduction of heat, solvents or artificial pressure into a subterranean reservoir containing heavy crude oil can significantly increase the amount of heavy crude oil recovered and rate recovery of such oil from such formation. See Redford, D. A. and Luhning, R. W., "In Situ Recovery from the Athabasca Oil Sands—Past Experience and Future Potential, Part II," Paper 95–24 published and delivered at the 46th Annual Meeting of the Petroleum Society of CIM, May 14–17, 1995.

The current state of the art reflects both an evolution of technology through general innovative improvement as well as innovation to meet conditions encountered in specific heavy crude oil bearing subterranean formations.

There are many methods proposed in the art for producing heavy crude oils. The use of horizontal wells for both the injection and production of fluids is preferred in much of the prior art and is taught by the present invention. See:

Nasr, T. N., "Analysis of Thermal Horizontal Well Recovery And Horizontal Well Bibliography," November 1990, Report #9091-12, Oil Sands and Hydrocarbon Recovery Department, Alberta Research Council; and G. S. Sawhney, "Steam-Assisted Gravity Drainage with Vertical Steam Injection Wells," Thesis for University of Calgary, National Library of Canada, TN 871 S29, 1993.

Many methods teach the recovery of heavy crude oils through the use of arrays of multiple horizontal well-bores, drilled from the surface, into the subterranean formation containing the heavy crude oil ("the reservoir"). For example, see:

U.S. Pat. No. 3,572,436 to Riehl,
U.S. Pat. No. 4,067,391 to Dewell,
U.S. Pat. No. 4,257,650 to Allen,
U.S. Pat. No. 4,296,969 to Willman,
U.S. Pat. No. 4,344,485 to Butler,
U.S. Pat. No. 4,385,662 to Mullins et al.,
U.S. Pat. No. 4,410,216 to Allen,
U.S. Pat. No. 4,510,997 to Fitch et al.,
U.S. Pat. No. 4,577,691 to Huang et al.,
U.S. Pat. No. 4,598,770 to Shu et al.,
U.S. Pat. No. 4,633,948 to Closmann et al.,
U.S. Pat. No. 4,850,429 to Mims et al.,
U.S. Pat. No. 5,033,546 to Combe,
U.S. Pat. No. 5,244,041 to Renard et al.,
U.S. Pat. No. 5,273,111 to Brannan et al.,
U.S. Pat. No. 5,318,124 to Ong et al.,
U.S. Pat. No. 5,407,009 to Butler et al.,
Canadian 1,304,287 to Edmunds et al. The injection of ethane, propane or butane in vapor form is known to the art:

R. M. Butler & I. J. Mokrys, "Solvent Analog Model of Steam-Assisted Gravity Drainage," AOSTRA Journal of Research, vol. 5, No. 1, Winter 1989, pp. 17–32;

R. M. Butler & I. J. Mokrys, "A New Process (VAPEX) for Recovering Heavy Oils Using Hot Water and Hydrocarbon Vapor," The Journal of Canadian Petroleum Technology, January–February 1991, vol 30, No. 1, pp. 97–106;

I. J. Mokrys & R. M. Butler, "The Rise of Interfering Solvent Chambers: Solvent Analog Model of Steam-Assisted Gravity Drainage", The Journal of Canadian Petroleum Technology, March 1993, vol. 32, No. 3, pp. 26–36;

I. J. Mokrys & R. M. Butler, University of Calgary, "In-Situ Upgrading of Heavy Oils and Bitumen By Propane Deasphaulting: The Vapex Process," Society of Petroleum Engineers, Inc., paper No. SPE 25452, Mar. 21–23, 1993, Oklahoma City, Okla., U.S.A., pp. 409–424;

S. K. Das. & R. M. Butler, "Further Studies of the 'Vapex' Process Using a Hele-Shaw Cell," Petroleum Society of CIM, paper No. CIM 93-50, May 9–13, 1993, Calgary, Alberta, Canada, 15 pages;

R. M. Butler & I. J. Mokrys, "Recovery of Heavy Oils Using Vaporized Hydrocarbon Solvents: Further Development of the Vapex Process," The Journal of Canadian Petroleum Technology, June, 1993, vol. 32, No. 6, pp. 56–63;

J. H. Duerksen & A. Eloyan, "Evaluation of Solvent-Based In Situ Processes For Upgrading And Recovery Of Heavy Oil and Bitumen," Proceedings from the UNITAR International Conference on Heavy Crude and Tar Sands, CONF-9502114, Feb. 12–17, 1995, Houston, Tex., USA, pp. 353–361;

R. M. Butler & I. J. Mokrys, University of Calgary, "The Solvent Requirements for Vapex Recovery," The Society of Petroleum Engineers, paper No. SPE 30293, Jun. 19–21, 1995, Calgary, Alberta, Canada, pp. 465–474; and U.S. Pat. No. 5,407,009 to Butler, et al.

The foregoing art teaches the use of multiple well-bore arrays to facilitate the application of various thermal or solvent processes under specific reservoir conditions. An invention which would enable the application of the same processes without the requirement of a multiple well-bore array would be an important improvement over the prior art cited above.

To this end, various methods prescribed in the art for recovering heavy crude oils from a subterranean reservoir teach the use of a single horizontal well-bore. For example see:

U.S. Pat. No. 4,116,275 to Butler et al.,
U.S. Pat. No. 4,508,172 to Mims et al.,
U.S. Pat. No. 4,565,245 to Mims et al.,
U.S. Pat. No. 4,640,359 to Livesey et al.,
U.S. Pat. No. 5,148,869 to Sanchez, and
U.S. Pat. No. 5,289,881 to Schuh
U.S. Pat. No. 5,511,616 to Bert Thus, the use of a single horizontal well-bore as a simultaneous injector and producer of fluids from the reservoir is known to those skilled in the art.

A major drawback of many of the single well processes taught in the art (See U.S. Pat. No. 5,289,881), is the difficulty in maintaining a fluid level around the horizontal section of the well-bore, while avoiding the percolation of injection fluid through the fluid being produced from the reservoir.

In processes involving the use of heated injection fluids, percolation of injection fluid through the fluid being produced from the reservoir often results in the overheating of the fluid being produced from the reservoir and a reduction of the thermal effectiveness and quality of the injection fluid. The overheating of the fluid being produced from the reservoir may lead to premature wear and failure of pumping equipment used to lift fluids from the reservoir through the horizontal well.

In processes involving the use of non-thermal injection fluids, the percolation of injection fluid through the fluids being produced from the reservoir often results in a loss of fluid quality through the wetting or condensing of the injection fluid, where the fluid is a condensable gas.

In processes involving the use of a single horizontal well to simultaneously inject and produce fluids, failure to maintain a sufficient fluid level around the horizontal section of the well-bore, can result in the injection fluid breaking through the fluids being produced from the well and being produced preferentially to the hydrocarbons within the reservoir. In addition to rendering the process inefficient, injection fluid override or breakthrough can also cause damage and premature wear or failure to pumping and production equipment. For example, the use of a jet pump (See U.S. Pat. No. 5,289,881 to Schuh) would suffer from such problems. The method taught by Schuh is difficult to apply due to the tendency for steam override to occur and to cause a vapor lock to occur at the pump. The overheating of the fluid being produced from the reservoir through the combination of injection fluid percolation and override could also cause flashing of some of liquids contained in the production fluid, when such fluids pass through the venturi of the jet pump.

Multiple well-bore arrays (See U.S. Pat. No. 4,344,485 and Canadian Patent 1,304,287) attempt to overcome these problems through the use of separate wells for the injection and production of fluids. Of course, two wells are more expensive than one.

To avoid the cost and operating complexity of using multiple well-bore arrays, some methods (See U.S. Pat. No. 5,148,869) attempt to address and solve the problems associated with maintaining a fluid level in processes involving the use of a single horizontal well by continuously and simultaneously injecting and producing fluids from a reservoir. However, these methods have their own shortcomings. For example, the method of U.S. Pat. No. 5,148,869 requires the use and orientation of specialized production casing.

Another method (See U.S. Pat. No. 5,511,616) teaches the formation of an inverted section at the tail of the horizontal well, with such inverted section having a build angle near ninety degrees, and terminating near the top of the reservoir containing the heavy crude oil. U.S. Pat. No. 5,511,616 teaches the injection of heated fluids through the inverted end of the horizontal well, in order to prevent the formation of a steam chest or chamber contacting the horizontal section of the well. However, as this portion of the well terminates near the top of the reservoir, this would result in steam prematurely contacting the top of the reservoir containing the heavy crude oil, without creating an acceptable level of mobility in respect of the heavy crude oil located between the base of the steam chamber and the horizontal section of the well.

In addition, U.S. Pat. No. 5,511,616 does not teach the use of unheated injection fluids (such as propane, butane, ethane or other solvents). However, even if such fluids were used, the injection of such fluids at the terminal end of the inverted section of the well would not facilitate the efficient mobilization of heavy crude oil located near the horizontal section of such well. As the solvents used to mobilize heavy crude oil have a higher specific gravity than the oil they are intended to mobilize, solvents injected at the top of the reservoir will preferentially form a chamber spreading out horizontally along the top of the reservoir, by-passing the oil lying below such chamber.

Thus, although much progress has been made in the employment of single horizontal wells to produce heavy crude oil by simultaneously injecting mobilizing fluids and producing mobilized oil, there are still deficiencies. These shortcomings demonstrate that further improvement is needed.

SUMMARY OF THE INVENTION

In accordance with the present invention, a method is provided for producing hydrocarbons from a subterranean formation. The method comprises the steps of: forming a well-bore having a horizontal section that is located within the formation, between the midpoint and the bottom of the formation, and close to the bottom of the formation; forming one end of the horizontal section of the well-bore to be above the highest point of the remainder of the horizontal section of the well-bore; completing the well-bore so that fluids can be injected into the formation through the horizontal section of the well-bore at a point located generally adjacent to the raised end of the horizontal section of the well-bore and so that fluids can be produced from the formation through the horizontal section of the well-bore along at least one position that is located below the raised end of the horizontal section of the well-bore; mobilizing a portion of the hydrocarbons within the formation and inducing such hydrocarbons to move towards the horizontal section of the well-bore in response to gravity drainage by injecting a fluid through the horizontal section and into the formation using the raised end of the horizontal section of the well-bore; and producing hydrocarbons and associated fluids from the formation through at least one position of the horizontal section of the well-bore, such that the production of the hydrocarbons occurs simultaneously with the injection of said fluid into the formation.

The preferred embodiment of the present invention teaches the use of an unheated hydrocarbon solvent as the injection fluid, which may or may not be a hydrocarbon but must be able to reduce the viscosity of hydrocarbons resident in a reservoir through solvent action upon such hydrocarbons while in the reservoir. While various fluids or combinations of fluid, in vapor or liquid form, may qualify and be utilized for this purpose in the practice of this invention, the preferred fluids are ethane, propane or butane injected in vapor form. In a preferred embodiment of the present invention, these fluids are injected as a saturated vapor. Practicing the present invention in this manner maximizes the benefits of the invention: (i) there is less concern over thermal loss, as there is if heated injection fluids, such as steam, are used; (ii) some upgrading of crude oil within the reservoir occurs, by separating out and leaving in the reservoir a significant fraction of the asphaltenes and heavier hydrocarbons contained within the crude oil; and (iii) the cost of recycling the preferred injection fluids is lower, when compared to the cost of recycling other possible injection fluids known in the art.

The present invention may be practiced using: (i) a heated injection fluid, in vapor or liquid form, such as steam or hot water, (ii) unheated solvents other than the preferred solvents, (iii) a combination of fluids, such as propane and steam, or (iv) the injection of different fluids or different combinations of fluids in an alternating fashion. However, when heated injection fluids are used, the use of an uninsulated injection tubing in the horizontal section of the well (as taught by U.S. Pat. No. 5,289,881, for example), is not recommended due to the loss of heat and thermal quality from the injection fluid as it passes through such tubing. The present invention also teaches the retention and maintenance of the quality of the injection fluid through to the point of injection into the formation.

The choice of fluids or combination of fluids used will depend on the nature, thickness, depth and composition of the reservoir containing the hydrocarbons, and the composition and nature of such hydrocarbons. However, the objective, which governs any selection and use of injection fluids in the practice of this invention, is to reduce the viscosity of the hydrocarbons found within the reservoir and to maximize the flow of the same, under gravity drainage, to the horizontal well-bore which, as taught by the present invention, is used to both inject and produce fluids from the reservoir.

For environmental and economic reasons, the present invention teaches the recovery and recycling of the injection fluid, where possible, through means known in the art.

Thus, those skilled in the art will see that the present invention poses many advantages over the prior art. Three important advantages are: reduced environmental impact, lower capital cost, and lower operating cost. In particular, the use of a horizontal well having a raised end to inject fluids provides a number of benefits over the prior art. Where unheated hydrocarbon solvents are used as injection fluids, the solvent value of such injection fluids is maximized, by preventing the percolation of such injection fluids through the fluids being produced from the reservoir. In the same manner, where heated injection fluids are used in the practice of the invention, the loss of heat from such injection fluids to the fluids being produced from the reservoir (and the potential for overheating the fluid being produced from the reservoir) is minimized. In both cases, the injection of fluids through the raised end of the horizontal well reduces the potential for injection fluid override and the premature wear of downhole pumping equipment.

Numerous other advantages and features of the present invention will become readily apparent from the following detailed description of the invention, the embodiments described therein, from the claims, and from the accompanying drawings.

DETAILED DESCRIPTION

Figure 1:
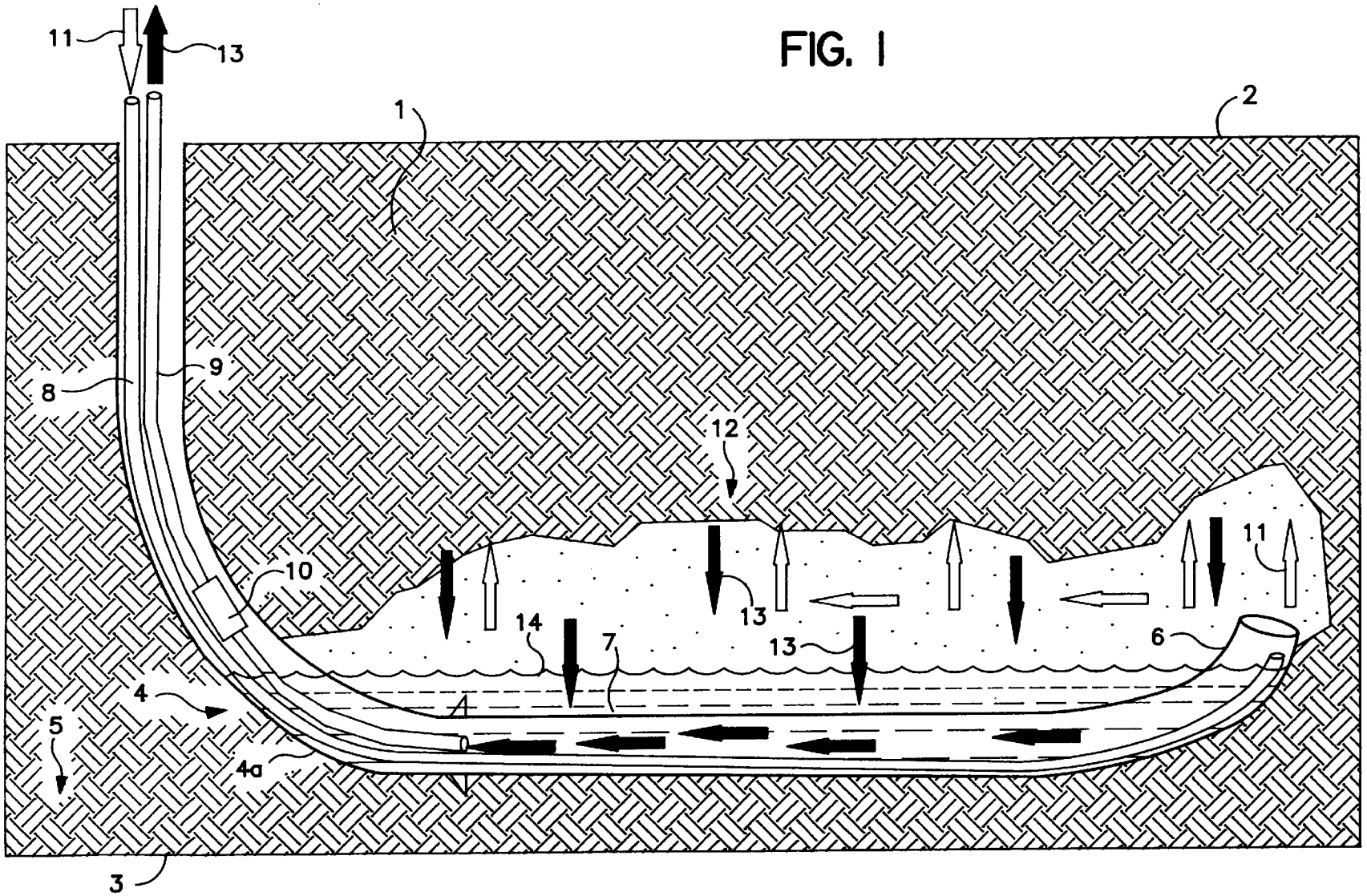
FIG. 1 shows, by side view, the approximate geometry of a horizontal well formed in accordance with the present invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to any specific embodiment so described.

Referring to FIG. 1 there is illustrated a single horizontal well 4 formed in a subterranean reservoir 1. The reservoir 1 is bounded by relatively impermeable upper and lower boundaries 2 and 3 and is composed of a permeable layer containing heavy crude oil. The reservoir 1 shown is exemplary for this process. Not all reservoirs will have this exact structure. Those skilled in the art know that reservoirs containing heavy crude oil can vary significantly in depth, location, nature, composition and structure.

The well 4 is formed from the surface using means known in the art. The vertical depth and horizontal length of the well is dependent upon the depth, location, composition and nature of the reservoir 1 containing heavy crude oil. However, a horizontal length in excess of 300 feet is preferred. The vertical depth of the well 4 should be sufficient to allow for placement of the horizontal portion of the well-bore as described hereafter. The well 4 is formed so that the horizontal section 4*a* of the well 4 is located above, but as close to the base 5 of the reservoir as possible. This well is formed so that the toe or far end 6 of the horizontal section 4*a* of the well is formed and ultimately lies above the highest point of the rest of the horizontal section of the well-bore. The vertical and horizontal reach of the raised end and the upward trajectory of the horizontal section 4*a* of the well-bore is determined by field observation and reservoir simulation, based on the nature, structure and composition of the reservoir and the heavy crude oil contained therein. The orientation of the horizontal section 4*a* of the well will be determined by factors such as the direction of the fracture trend and the regional dip of the reservoir.

Multiple horizontal wells may be drilled into the reservoir in the manner prescribed above. However, each well will operate as a separate injection/production unit. Fluid and pressure communication between wells may be of benefit in enhancing the process. However, locating wells too close together may inhibit the operation of the process taught by this invention. Location of new wells too close to existing wells, which have been undergoing the process taught by this invention for some time, may render the application of such process through such new well ineffective. Spacing between horizontal wells (formed as taught by this invention) should consider the nature of the reservoir, the kind of heavy crude oil contained therein, and the production history of such reservoir.

Referring again to FIG. 1, once the horizontal section 4*a* of the well-bore has been formed within the reservoir 1, the well must be "completed" using means known in the art.

While the horizontal section of the well-bore 4 is being completed 7, injection tubing 8 is installed from the surface. The injection tubing transverses substantially the entire length of the well. Production tubing 9 is installed from and connects to the surface. The production tubing 9 runs to a low point (if possible the lowest point) in the horizontal section 4a of the well-bore. The completion of such well may also require the installation of artificial lift equipment known in the art, such as a downhole pump 10. Although the inventors recommend the completion of the horizontal section 4*a* of the well-bore using a slotted liner, screen or drilled liner 7, where the nature and composition of the reservoir will allow the completion of the well without the use of a liner within the horizontal section of the well-bore, this feature may be eliminated.

At the surface, equipment for the injection of fluid and the production of heavy crude oil and associated liquids is installed and connected to the well 4. The nature and installation of such equipment is determined and accomplished through means known in the art. If a hydrocarbon solvent, steam or water is used as the injection fluid, such equipment preferably will include facilities for the recovery and recycling of such injection fluid. However, where steam or water is used as the injection fluid, the use of such facilities may be eliminated and facilities for the disposal of produced water may be utilized in their place.

Upon formation and completion of the well-bore 4, a process begins with the injection of the selected injection fluid, using the injection tubing 8 through means known in the art. In a preferred embodiment of the present invention, ethane, propane or butane are used in vapor form as the injection fluid. In order to mobilize a portion of the heavy crude oil within the reservoir 1 and cause such hydrocarbons and associated fluids to flow to the horizontal section 4*a* of the well-bore in response to gravity drainage, these fluids are injected in the vapor phase at or just below the saturation point, into the reservoir at the toe 6 of the well-bore, through the injection tubing 8, using means known in the art. For example, U.S. Pat. No. 5,407,009 to Butler et al. teaches that the injection pressure should be selected and maintained so that the injection fluid remains in the vapor phase as close to the saturation point as possible. This will increase both the percentage of oil mobilized and the asphaltenes precipitated out of the oil. The rate of injection of the solvent should be controlled in order to prevent the formation of too high a concentration of solvent within the reservoir which could lead to localized plugging of the reservoir through the excessive precipitation of asphaltenes. Also, fluid injection pressure should be kept below the parting pressure of the reservoir. Prediction of a precise range of desirable solvent concentration is not possible, as the rate of injection and desired concentration will depend on the nature and composition of the reservoir and the fluids contained therein. Cores and samples of the fluid within the reservoir may be taken and analyzed before commencing the injection of the solvent to determine the preferred rate of injection and target level or range of solvent concentration. Pressure and temperature within the reservoir may also be taken into account in this evaluation. Once the injection of solvent commences, the fluid produced from the reservoir should be analyzed from time to time and the rate of solvent injection adjusted accordingly to ensure that the target range of solvent concentration (as determined through the analysis performed prior to the commencement of solvent injection) is met. Pressure and temperature changes in the reservoir should also be monitored and taken into account in the adjustment of injection rates, once the injection of solvent commences.

The lifting of crude oil and associated fluids from the reservoir may be accomplished by any appropriate means known in the art. The selection of a lifting method will depend on the choice of injection fluid, the nature of the fluids to be produced from the reservoir, the nature of the reservoir itself and other factors known to those skilled in the art. Of course, intake of the pump should be below the range in elevation of the fluid level around the horizontal section of the well-bore.

Referring to FIG. 1, as the solvent or injection fluid 11 is injected into the reservoir 1, it rises, diluting and reducing the amount of asphaltenes and heavier ends contained in the native heavy crude oil within the reservoir 1, eventually forming a chamber 12. The fluid mixture 13 of diluted and upgraded oil and condensed solvent flows downward through the formation in response to gravity, where it pools around the horizontal portion of the well-bore 4. There it is gathered, through the production tubing 9, and removed to the surface. The chamber 12 formed as a result of the injection of solvent 11 into the reservoir 1 gradually expands horizontally as well as vertically along the length of the horizontal section 4*a* of the well-bore 4 as a result of the production of fluids 13 from the reservoir.

While the preferred embodiment of the present invention teaches the use of an unheated solvent to produce heavy crude oil from a reservoir, those skilled in the art will recognize the value of creating and using a raised section at the end of the horizontal section of a horizontal well-bore to inject both heated and unheated fluids to produce both lighter crude oils and heavy crude oil from a reservoir. Thus, through the injection of fluid at or near the raised end or toe 6 of the well-bore, a level of fluid 14 develops. This fluid is composed of a mixture of diluted and upgraded oil and condensed injection fluid 13. It forms and is maintained above and around a major part of the horizontal section 4*a* of the well-bore. This fluid level is below the raised end 6 of the horizontal section 4*a*. The creation and maintenance of this fluid level 14 tends to prevent the injection fluid vapor from overriding the process and breaking through the mixture 13 of produced fluids. Such breakthrough can result in the production of such uncondensed vapor, leading to premature wear or failure of the artificial lift equipment 10, as well as a reduction in the efficiency of the process. Those skilled in the art will recognize that this embodiment applies with equal value and utility, where this invention is practiced using a variety of injection fluids or mixtures of injection fluids, including without limitation, steam.

Although a variety of fluids or mixture of fluids may be used in the practice of this invention, in all cases such fluids should be injected through the horizontal section 4*a* of the well-bore at a point located at or near the toe 6 of the well-bore. Where recoverable fluids are used as the injection fluid, such fluids may be separated and recovered at the surface from the mixture 13 of fluids produced from a well, through means known in the art. Regardless of the fluid used as the injection fluid, simultaneous injection of the injection fluid 11 and production of the mixture 13 of diluted and upgraded oil and injection fluid from the reservoir 1 is preferred.

The present invention will operate with greatest efficiency in reservoirs characterized by high permeability (1 darcy or greater), as typically found in heavy oil bearing reservoirs composed of unconsolidated material. However, where reservoir conditions are less than ideal, means (e.g., fracturing, acidizing the reservoir, etc.) known in the art can be used to improve reservoir permeability and to facilitate the efficient performance of the process of the invention.

Where initial conditions within the reservoir 1 initially do not provide sufficient "injectivity" to allow for the commencement of simultaneous production and injection of fluids, other processes known in the art (such as cyclic injection and production of fluids, primary production, or fracturing of the reservoir) may be applied using such well until such injectivity is created. Upon sufficient injectivity being created/increased, the process of simultaneous injection and production of fluids from the reservoir, as taught by this invention, may be commenced.

In the practice of this invention, fluids produced from the well formed and used as taught by this invention are, upon reaching the surface, handled, processed, treated, stored, recycled or disposed of, as the case may be, using methods know in the art. Where the injection fluid produced with the fluids removed from the reservoir is recycled, it will be re-injected in the manner described above.

When the reservoir has been produced to the point of maximum economic recovery of the heavy crude oil found within the reservoir through the horizontal well-bore 4*a* taught by this invention, a portion of the injection fluid injected into the reservoir through such well-bore and remaining within the reservoir may be recovered to a large extent through ceasing further injection, and producing such fluid through the horizontal well used to inject such fluid by means known in the art. The amount of the residual injection fluid recovered will depend on the method employed and the nature of the reservoir. Those skilled in the art will realize that injection fluid remaining within the reservoir will be recovered when the recovered fluid has economic value sufficient to justify the cost of producing and recovering such fluid.

Although multiple horizontal wells may be formed and operated as taught in the present invention, within and in respect of the same reservoir, each well will operate as a separate injection/production unit. However, those skilled in the art will recognize that, in certain reservoirs, it may be possible to form and operate multiple horizontal wells (in the manner taught by the present invention), in such a way that simultaneous injection and production of fluids through any well can have a positive benefit on adjacent wells. Similarly a well formed in accordance with the present invention may benefit from the injection and production of fluids from adjacent wells. The operation of individual fluid injection/production units in this manner is demonstrated by U.S. Pat. No. 5,318,124 to Ong et al.

With respect of any single well formed as taught by the present invention, the recovery of injection fluids from within the reservoir will usually take place as soon as possible after the point of maximum economic recovery of heavy crude from the reservoir through such well has been reached. However, such recovery may be delayed where the removal of injection fluid remaining within the reservoir could negatively affect the production of fluids from the reservoir through any offsetting well.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the shape, materials, size and arrangement of parts. Moreover, equivalent techniques and steps (taken individually or together) may be substituted for those illustrated and described. Also certain features of the invention may be used independently of other features of the invention. For example, the present invention is not limited to the use of propane, butane or ethane as injection fluids. Reference to the use of propane, butane, ethane and methane, in the above description, while often preferred for a variety of reasons known to those skilled in the art, is by way of example only. Those skilled in the art will understand from the foregoing description that this invention may be practiced using a variety of injection fluids or mixtures of injection fluids. Such injection fluids include, without limitation, steam, water, hydrocarbon solvents (in either a liquid or gaseous state), or any combination or combinations thereof. In applying the process of the invention, the nature, type and composition of the injection fluid should be considered in relation to the formation in which it is used. By "nature" is meant the manner in which the substance operates to reduce the viscosity of the oil (e.g., hydrocarbon solvents vs. steam/water) and the physical state of the injected substance (gas vs. liquid). By "type"0 is meant the characteristics of the substance (e.g., water and steam and inert are relatively benign compared to a hydrocarbon solvent). By "composition" is meant the chemical or molecular composition of the injected substance or mixture thereof. Thus, the present invention should not be limited by the details specified or by the specific embodiments chosen to illustrate the invention or the drawings attached hereto. Thus, it will be appreciated that such modifications, alternatives, variations, and changes may be made without departing from the spirit and scope of the invention as defined in the appended claims. It is, of course, intended to cover by the appended claims all such modifications involved within the scope of the claims.

We claim:

1. A method of producing hydrocarbons and associated fluids from a subterranean formation containing such hydrocarbons and fluids, comprising the steps of:

a) forming a well-bore having a horizontal section that is located within the formation, between the midpoint and the bottom of the formation, and close to the bottom of the formation;

b) forming one end of said horizontal section of the well-bore to be raised above the highest point of the remainder of said horizontal section of the well-bore;

c) completing the well-bore so that fluids can be injected into the formation through said horizontal section of the well-bore at a point located generally adjacent to said raised one end of said horizontal section of the well-bore, and so that fluids can be produced from the formation through said horizontal section of said well-bore along at least one position that is located below said raised one end of said horizontal section of said well-bore;

d) mobilizing a portion of the hydrocarbons within the formation and inducing such hydrocarbons to move towards said horizontal section of said well-bore in response to gravity drainage by injecting a fluid through said horizontal section and into the formation using said point located generally adjacent to said raised one end of said horizontal section of the well-bore; and e) producing hydrocarbons and associated fluids from the formation through said at least one position of said horizontal section of the well-bore, such that the production of said hydrocarbons occurs simultaneously with the injection of said fluid into the formation.

2. The method as set forth in claim 1, where in performing step (b) said end of said horizontal section of said well-bore is formed and ultimately lies at least two meters above said highest point of said remainder of said horizontal section of the well-bore.

3. The method as set forth in claim 1, where in performing step (d) said injected fluid is a heavy oil solvent.

4. The method as set forth in claim 3, where in performing step (d) said injected fluid is a hydrocarbon solvent; and wherein said solvent is injected in its vapor phase at or just below its saturation point.

5. A method of producing hydrocarbons and associated fluids from a subterranean formation containing such hydrocarbons and fluids, comprising the steps of:

a) forming a well-bore having a horizontal section that is located within the formation, between the midpoint and the bottom of the formation, and close to the bottom of the formation;

b) forming one end of said horizontal section of the well-bore to be above the highest point of the remainder of said horizontal section of the well-bore;

c) completing the well-bore so that fluids can be injected into the formation through said horizontal section of the well-bore at a point located generally adjacent to said one end of said horizontal section of the well-bore, and so that fluids can be produced from the formation through said horizontal section of said well-bore along at least one position that is located below said raised one end of said horizontal section of said well-bore;

d) mobilizing a portion of the hydrocarbons within the formation and inducing such hydrocarbons to move towards said horizontal section of said well-bore in response to gravity drainage by injecting a fluid through said horizontal section and into the formation using said raised one end of said horizontal section of the well-bore, where in performing step (d) said injected fluid is selected from the group consisting of propane, butane, methane and ethane and wherein said injected fluid is injected in its vapor phase at or just below its saturation point; and e) producing hydrocarbons and associated fluids from the formation through said at least one position of said horizontal section of the well-bore, such that the production of said hydrocarbons occurs simultaneously with the injection of said fluid into the formation.

6. The method as set forth in claim 1, where in performing step (d) the injected fluid is a dry vapor.

7. The method as set forth in claim 1, where in performing step (d) said injected fluid is a condensable gas.

8. The method as set forth in claim 1, where in performing step (d) said injected fluid is heated to a temperature greater than the temperature of the hydrocarbons in the formation for the purpose of heating and mobilizing the hydrocarbons.

9. The method as set forth in claim 1, where in performing step (d) said injected fluid is selected from the group consisting of steam and hot water.

10. The method as set forth in claim 1, where in performing step (d) said injected fluid comprises a mixture of fluids.

11. A method of producing hydrocarbons and associated fluids from a subterranean formation containing such hydrocarbons and fluids, comprising the steps of:

a) forming a well-bore having a horizontal section that is located within the formation, between the midpoint and the bottom of the formation, and close to the bottom of the formation;

b) forming one end of said horizontal section of the well-bore to be above the highest point of the remainder of said horizontal section of the well-bore;

c) completing the well-bore so that fluids can be injected into the formation through said horizontal section of the well-bore at a point located generally adjacent to said one end of said horizontal section of the well-bore, and so that fluids can be produced from the formation through said horizontal section of said well-bore along at least one position that is located below said raised one end of said horizontal section of said well-bore;

d) mobilizing a portion of the hydrocarbons within the formation and inducing such hydrocarbons to move towards said horizontal section of said well-bore in response to gravity drainage by injecting a fluid through said horizontal section and into the formation using said raised one end of said horizontal section of the well-bore, wherein said injected fluid comprises a mixture of methane and propane in vapor form; and e) producing hydrocarbons and associated fluids from the formation through said at least one position of said horizontal section of the well-bore, such that the production of said hydrocarbons occurs simultaneously with the injection of said fluid into the formation.

12. The method as set forth in claim 10, wherein said injected fluid comprises a mixture of steam and a solvent.

13. The method as set forth in claim 10, wherein said injected fluid comprises a mixture of steam and hot water.

14. The method as set forth in claim 10, wherein said injected fluid comprises a mixture of hot water and a solvent.

15. The method as set forth in claim 10, wherein said injected fluid comprises a mixture of steam, hot water and a solvent.

16. The method as set forth in claim 1, where in performing step (d) at least one of the nature, type and composition of said injected fluid is changed over time, such that at least more than one injected fluid or mixture of injected fluids is used.

17. The method as set forth in claim 1, wherein before performing step (d) the following step is performed: increasing the injectivity of formation.

18. The method as set forth in claim 1, further including the step of improving reservoir permeability.

19. The method as set forth in claim 1, further including the step of recovering injected fluid that is produced from the reservoir in conjunction with the hydrocarbons and associated fluids produced from the formation.

20. The method as set forth in claim 19, where in performing step (d), said recovered fluid is injected into the formation through said raised end of said horizontal section of said well-bore.

21. A method of producing hydrocarbons and associated fluids from a subterranean formation containing such hydrocarbons and fluids, comprising the steps of:

a) forming a well-bore having a horizontal section that is located within the formation, between the midpoint and the bottom of the formation, and close to the bottom of the formation;

b) forming one end of said horizontal section of the well-bore to be above the highest point of the remainder of said horizontal section of the well-bore;

c) completing the well-bore so that fluids can be injected into the formation through said horizontal section of the well-bore at a point located generally adjacent to said one end of said horizontal section of the well-bore, and so that fluids can be produced from the formation through said horizontal section of said well-bore along at least one position that is located below said raised one end of said horizontal section of said well-bore;

d) mobilizing a portion of the hydrocarbons within the formation and inducing such hydrocarbons to move towards said horizontal section of said well-bore in response to gravity drainage by injecting a fluid through said horizontal section and into the formation using said raised one end of said horizontal section of the well-bore, where said injected fluid is selected from at least one of the group consisting of propane, butane, methane, ethane and mixtures thereof;

e) producing hydrocarbons and associated fluids from the formation through said at least one position of said horizontal section of the well-bore, such that the production of said hydrocarbons occurs simultaneously with the injection of said fluid into the formation, and wherein at least one of the fluids of propane, butane, methane and ethane of step (d) is produced from the reservoir in conjunction with the hydrocarbons and associated fluids produced from the reservoir; and (f) recovering and re-injecting said at least one fluid into the formation as a saturated or near saturated vapor using said raised one end of said horizontal section of said well-bore.

22. The method as set forth in claim 1, wherein, after further recovery of hydrocarbons through injection of fluids through the horizontal section of the well-bore is not economical, production of hydrocarbons ceases without recovery of injected fluids.

23. The method as set forth in claim 1, wherein, at the point where further recovery of hydrocarbons from the introduction of injection fluids through said horizontal section of said well-bore is not economical, step (d) is discontinued, and production of hydrocarbons and associated fluids, including any of said injected fluid remaining in the reservoir, continues until it is no longer economical to continue such production.

24. A method of producing hydrocarbons and associated fluids from a subterranean formation containing such hydrocarbons, comprising the steps of:

(1) forming, between the midpoint and the bottom of the formation and as close to the bottom of the formation as possible, a predominately horizontal well-bore having an open end that lies above substantially the rest of said predominately horizontal section of said well-bore;

(2) completing the well-bore for production of hydrocarbons from the formation using at least one point that is located intermediate the ends of said predominantly horizontal section of said well-bore and that is lower than said open end;

(3) injecting a fluid into the formation through said predominately horizontal section of the well-bore by using said open end of the well-bore to mobilize at least a portion of the hydrocarbons within the formation for movement towards said predominately horizontal section of said well-bore in response to gravity drainage, and simultaneously producing hydrocarbons and said injected fluid through said predominately horizontal section of said well-bore; and (4) recovering said injected fluid produced from step (3) and reinjecting such recovered injected fluid back into the formation while repeatedly performing step (3).

25. The method as set forth in claim 24, wherein said injected fluid is a solvent that mobilizes the hydrocarbons and associated fluids within the formation.

26. The method as set forth in claim 24, wherein said injected fluid comprises a hydrocarbon solvent.

27. The method as set forth in claim 26, wherein said hydrocarbon solvent is selected from the group consisting of propane, butane, methane and ethane; and wherein said hydrocarbon solvent is injected as a vapor at or just below its saturation point.

28. The method as set forth in claim 24, wherein said injected fluid comprises a dry vapor.

29. The method as set forth in claim 24, wherein said injected fluid comprises a condensable gas.

30. The method as set forth in claim 24, where in performing step (3) said injected fluid is heated and to a temperature greater than the temperature of the hydrocarbons in the formation for the purpose of heating and mobilizing said hydrocarbons within the formation.

31. The method as set forth in claim 24, wherein said injected fluid is selected from the group consisting of steam and hot water.

32. The method as set forth in claim 24, wherein said injected fluid comprises at least two fluids.

33. The method as set forth in claim 32, wherein said injected fluid comprises a mixture of methane and propane.

34. The method as set forth in claim 32, wherein said injected fluid comprises a mixture of steam and a solvent.

35. The method as set forth in claim 32, wherein said injected fluid comprises a mixture of steam and hot water.

36. The method as set forth in claim 32, wherein said injected fluid comprises a mixture of hot water and a solvent.

37. The method as set forth in claim 24, wherein said injected fluid comprises a mixture of steam, hot water and a solvent.

38. The method as set forth in claim 24, where in performing step (3) at least one of the state, type and composition of the injected fluid is changed over time, such that more than one injected fluid or mixture of injected fluids is used.

39. The method as set forth in claim 24, further including the step of creating injectivity in the formation.

40. The method as set forth in claim 24, further including the step of improving reservoir permeability before performing step (3).

41. The method as set forth in claim 24, wherein, after further recovery of hydrocarbons from the introduction by injection fluids through said horizontal section of said well-bore is not economical, step (3) is discontinued and production of hydrocarbons and associated fluids, including any of said injected fluid remaining in the reservoir, continues until it is no longer economical to continue such production.

42. A method of producing hydrocarbons and associated fluids from a subterranean formation containing such hydrocarbons and associated fluids, comprising the steps of:

(i) forming a predominately horizontal well-bore, between the midpoint and the bottom of the formation, and as close to the bottom of the formation as possible, said well-bore having a raised end that is formed and ultimately lies at least 2 meters above the rest of the predominately horizontal section of the well-bore;

(ii) completing said well-bore for fluids to be injected into the formation through said predominately horizontal section of the well-bore at an injection point located adjacent to said raised end of said well-bore, and for hydrocarbons to be produced from the formation through a production point between the ends of the well-bore and lower than said raised end of said well-bore;

(iii) injecting a fluid comprising at least one of propane, butane, ethane, methane and mixtures thereof, in the form of a saturated vapor, into the formation through said injection point for mobilizing at least a portion of the hydrocarbons within the formation for movement towards said predominately horizontal section of said well-bore;

(iv) simultaneously producing hydrocarbons and associated fluids and said injected fluid through said predominately horizontal section of said well-bore; and (v) recovering at least a portion of said injected fluid from said fluids produced from the formation in step (iv) and reinjecting such recovered injected fluid back into the formation in the form of a saturated vapor as in step (iii).

43. The method as set forth in claim 42, wherein at least one of the nature, type and composition of the injected fluid is changed from time to time, such that more than one injected fluid, or mixture of injected fluids, is used in performing step (iii).

44. The method as set forth in claim 42, wherein before performing steps (iii) and (iv), injectivity is created in the formation.

45. The method as set forth in claim 42, wherein before performing step (iv) reservoir permeability is improved.

46. The method as set forth in claim 42, where in performing step (iii) at the point where further recovery of hydrocarbons through the further injection of fluids through said predominately horizontal section of the well-bore is no longer economical, the injection of fluids through the well-bore ceases and the production of hydrocarbons and associated fluids, including any injected fluid remaining in the reservoir, continues until it is no longer economical to continue such production without injection of fluids.

47. The method as set forth in claim 42, where in performing step (iii) the injected fluid is a dry vapor.

48. Apparatus for producing hydrocarbons from a subterranean formation containing such hydrocarbons and associated fluids, comprising:

a predominately horizontal well-bore located between the midpoint and the bottom of the formation and as close to the bottom of the formation as possible, said well-bore having a raised end that lies at least 2 meters above the rest of said predominately horizontal section and that is used for injecting fluids into the formation, and said well-bore having at least one completed section that is located below said raised end of said well-bore for producing hydrocarbons from the formation in response to the injection of fluids through said raised end and that is adapted to receive and withdraw from the formation mobilized hydrocarbons drawn thereto by gravity drainage: and means for injecting propane, butane, ethane, methane and mixtures thereof in the form of a saturated vapor through said raised end.

* * * * *

UNITED STATES PATENT AND TRADEMARK OFFICE
CERTIFICATE OF CORRECTION

PATENT NO.: 5,771,973

DATED: June 30, 1998

INVENTOR(S): Earl M. Jensen, Kurt D. Uhrich, David J. Hassan

It is certified that error appears in the above-identified patent and that said Letters Patent is hereby corrected as shown below:

Patent reads:

| Col. | Line | |
|---|---|---|
| 10 | 17 | reads "By "type"0 is meant the characteristics" should read --By "type" is meant the characteristics-- |

Signed and Sealed this

Second Day of March, 1999

Q. Todd Dickinson

*Attest:*

Q. TODD DICKINSON

*Attesting Officer*

*Acting Commissioner of Patents and Trademarks*